US006364377B1

(12) United States Patent
Ferguson

(10) Patent No.: US 6,364,377 B1
(45) Date of Patent: Apr. 2, 2002

(54) LOCK MECHANISM

(76) Inventor: Gordon A. Ferguson, 165 Peter St., P.O. Box 326, Lindsay, Ontario (CA), K9V 4S3

( * ) Notice: Subject to any disclaimer, the term of this patent is extended or adjusted under 35 U.S.C. 154(b) by 0 days.

(21) Appl. No.: 09/565,745

(22) Filed: May 8, 2000

(51) Int. Cl.[7] ..... E05C 1/10
(52) U.S. Cl. ..... 292/175; 292/302; 27/DIG. 1
(58) Field of Search ..... 292/175, 302, 292/300, 341.15, DIG. 37, DIG. 11; 27/DIG. 1

(56) References Cited

U.S. PATENT DOCUMENTS

| | | | | |
|---|---|---|---|---|
| 187,883 A | | 2/1877 | McCarthy | |
| 299,140 A | * | 5/1884 | Hill | 27/DIG. 1 |
| 896,495 A | | 8/1908 | Wentz | |
| 1,178,736 A | * | 4/1916 | Barre | |
| 2,323,674 A | | 7/1943 | Purkiss | |
| 2,817,551 A | | 12/1957 | Gieleghem | |
| 3,002,365 A | | 10/1961 | Liljequist | |
| 3,160,431 A | | 12/1964 | Anderson et al. | |
| 3,314,705 A | | 4/1967 | Lichtenberger | |
| 3,752,520 A | * | 8/1973 | Sprick | 292/302 |
| 4,520,546 A | | 6/1985 | Darnell | |
| 5,042,854 A | | 8/1991 | Huang | |
| 6,152,499 A | * | 11/2000 | Robert | 292/DIG. 11 |

FOREIGN PATENT DOCUMENTS

| | | | | |
|---|---|---|---|---|
| CH | 924409 | * | 5/1938 | 292/302 |

* cited by examiner

*Primary Examiner*—Flemming Saether
(74) *Attorney, Agent, or Firm*—Riches, McKenzie & Herbert LLP

(57) ABSTRACT

An improved lock mechanism for connecting an upper lid portion to a lower box portion is provided. The upper lid portion is provided with a locking pin extending downwardly from a lower surface of the upper lid portion. The lower box section has a vertical pin receiving socket extending from an opening in an upper surface of the lower box portion to receive the locking pin. The pin receiving socket opens into a horizontal slide bore extending from an opening in a front surface of the lower box section. A lock button, having a lock slot and a slide slot, is slidably disposed within the slide bore between a forward extended position and a depressed rearward position. A spring biases the lock button to the forward extended position. In the forward extended position, the lock slot secures the upper lid to the lower box by releasably engaging the enlarged head of the locking pin, which extends through the pin receiving socket into the slide bore. A slide stop, inserted into the slide slot, maintains the lock button within the slide bore. The slide stop is inserted into the slide slot through the pin receiving socket, through the slide bore and into the slide slot.

19 Claims, 4 Drawing Sheets

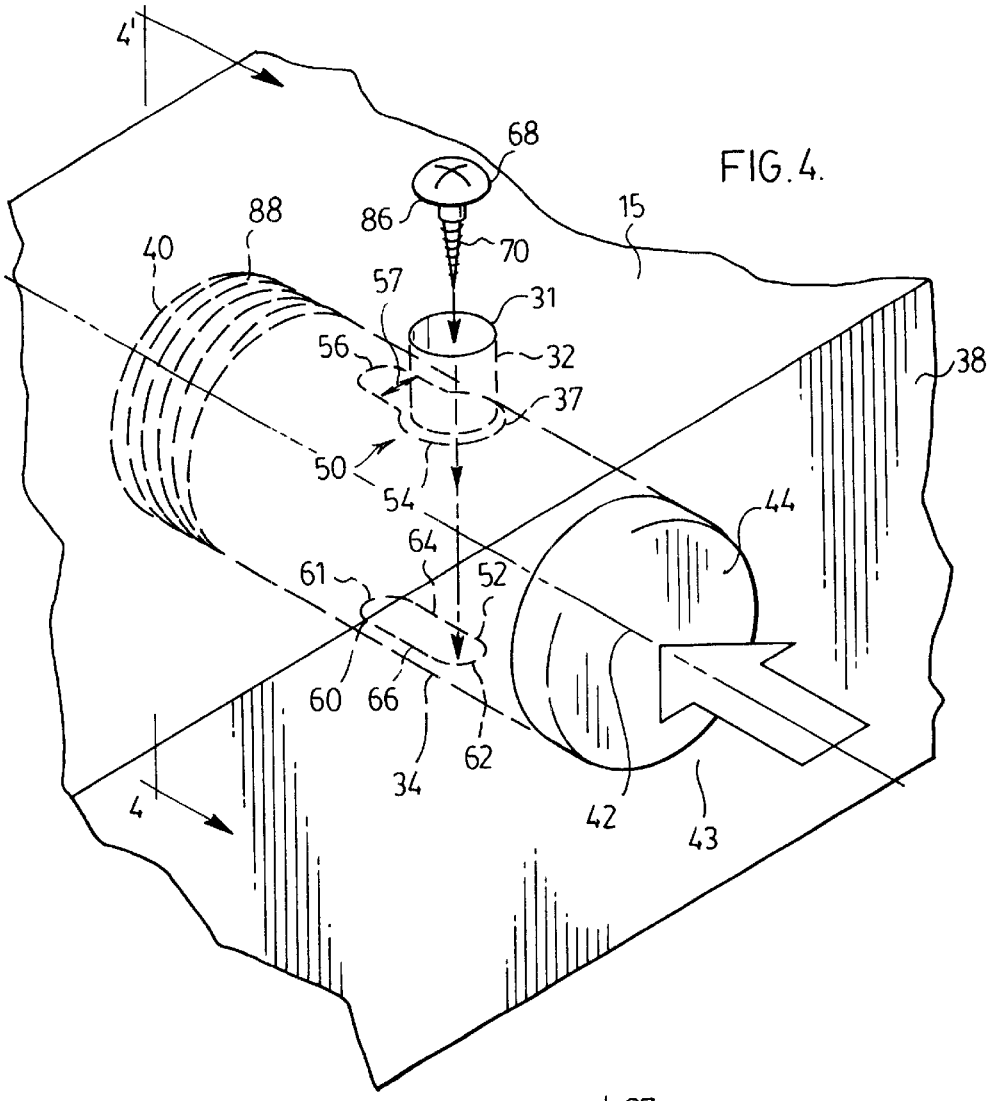
FIG. 4.
FIG. 5.
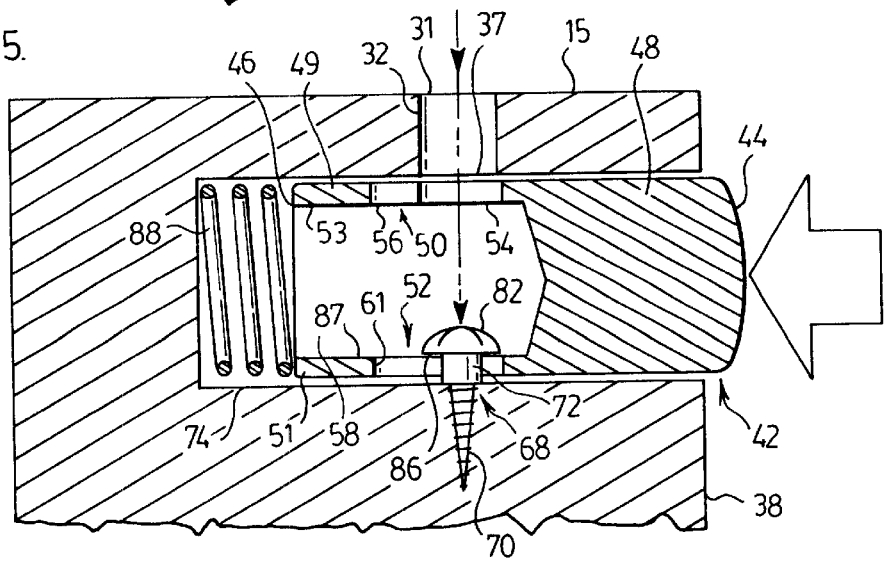

FIG.6.
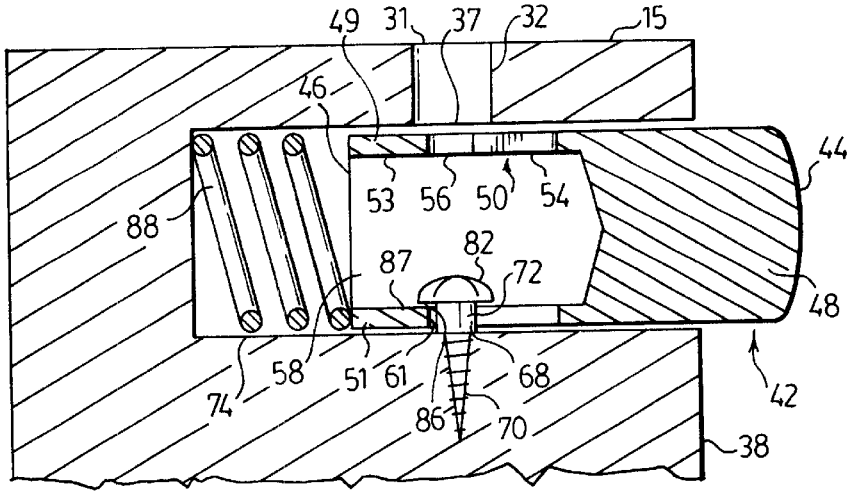
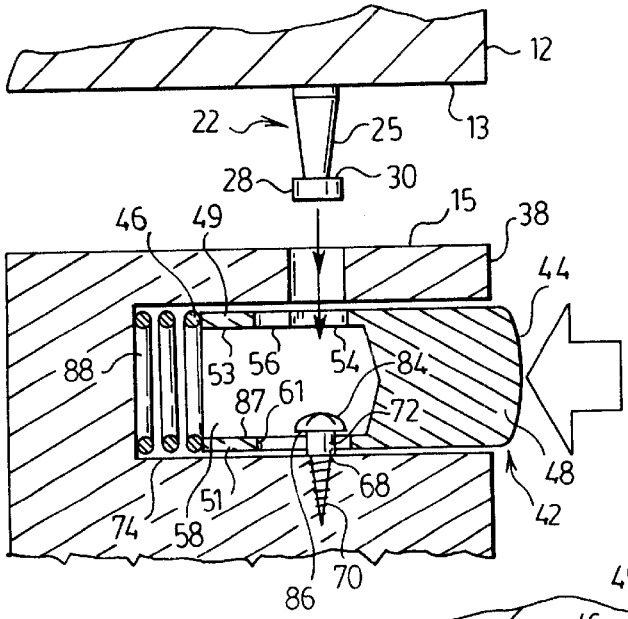
FIG.7.
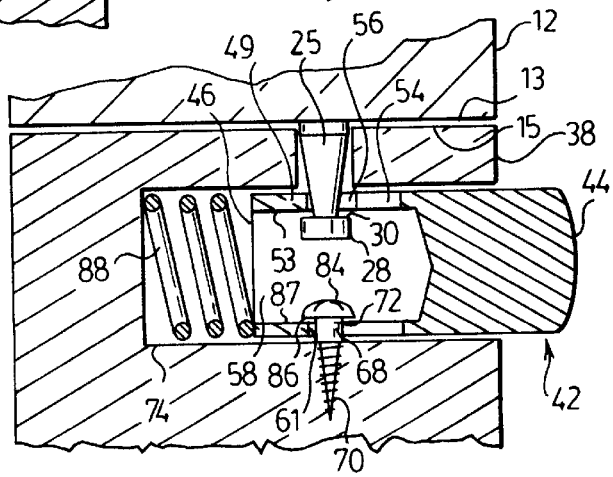
FIG.8.

LOCK MECHANISM

TECHNICAL FIELD OF THE INVENTION

The invention relates to an improved lock mechanism, more particularly an improved lock mechanism for caskets or coffins.

BACKGROUND OF THE INVENTION

Lock mechanisms in general, and, in particular, lock mechanisms for caskets or coffins, are well known. However, previously known lock mechanisms suffer the disadvantages that they involve a number of parts, are expensive and/or are difficult to install.

Many of the prior art devices further suffer the disadvantage that they do not provide an easy to use, push style locking mechanism that is easy to install and can be produced at low cost. Many of the prior art devices also have the disadvantage that they require anchoring collar, tabs or face plates which may detract from the aesthetic appeal of the casket.

SUMMARY OF THE INVENTION

An object of the present invention is to provide an easy to use, push style, locking mechanism for securing a first member to a second member, which can be easily installed and produced at low cost.

Another object of the present invention is to provide an easy to use, push style, locking mechanism in a casket.

Yet another object the present invention is to provide a construction in which a push button is received in a bore in the wood which forms the casket.

To at least partially overcome the disadvantages of the previously known devices, the present invention provides an improved lock mechanism for connecting an upper lid portion to a lower box portion. The upper lid portion is provided with a locking pin, which extends downwardly from a lower surface of the upper lid portion. The locking pin has an enlarged head portion, which can be releasably engaged by a lock button.

The lower box section has a substantially vertical pin receiving socket extending from an opening in an upper surface of the lower box portion. The pin receiving socket opens into a substantially horizontal slide bore extending from an opening in a front surface of the lower box section to a blind end. The pin receiving socket is sized to receive the locking pin when the upper lid portion is closed. The slide bore is sized to slidably receive the lock button.

The lock button is slidable between a forward extended position and a depressed rearward position within the slide bore. A spring biases the lock button toward the forward extended position. Upon the application of a force acting against a force exerted by the spring, the lock button can slide from the forward extended position to the rearward depressed position.

The lock button has an upper surface in which is formed a lock slot. The lock slot is shaped to releasably engage an enlarged head portion of the locking pin. The lock button also has a lower surface diametrically opposed to the upper surface, in which is formed a slide slot. The lock button is partially hollow so as to form a lock button opening. In turn, the lock button opening forms a passage from the lock slot to the slide slot. The lock button is slidably maintained in the slide bore by way of a slide stop, inserted into the slide slot. The slide stop is inserted into the slide slot through the pin receiving socket and the passage.

When the lock button is in the forward extended position, the lock slot engages the enlarged head of the locking pin releasably securing the upper lid to the lower box. To release the upper lid, the lock button is simply slid into the rearwardly depressed position releasing the enlarged head of the locking pin.

A feature of the present invention is the provision of the pin receiving socket as a passageway through which slide stop may be inserted during assembly to maintain the lock button in the slide bore.

Accordingly, one aspect of the present invention provides a lock mechanism releasably securing a first member to a second member; the first member having a male locking pin member extending therefrom, the pin member having a distal end; the second member having a female socket extending about a socket axis and having an open socket end; the male locking pin member axially slidable into and out of the female socket via the open socket end between a withdrawn position in which the pin member is withdrawn from the socket and a fully seated position in which the pin member is coaxially received in the socket for locking in the socket against removal; the second member having a lock button receiving bore disposed about a lock axis, the lock button receiving bore having an open forward end and a closed rear end, the lock button receiving bore intersecting with the female socket with the lock axis intersecting the socket axis to extend transversely thereto; a lock button member disposed about a button axis, the lock button member coaxially slidably received in the lock button receiving bore for movement between a forward position and a rearward position; a slide stop member in the lock button receiving bore engaging an axially forwardly directed shoulder of the lock button member to limit forward movement of the lock button member in the lock button receiving bore to the forward position and prevent removal of the lock button member out of the forward end of the lock button receiving bore and to prevent relative rotation of the lock button member about the lock axis; a lock button opening extending radially through the lock button member providing access to the slide stop member and permitting insertion of the slide stop member through the lock button member for securing the lock button member in the lock button receiving bore during assembly and the lock button opening is coaxially aligned with the female socket when the lock button member is in an assembly position in the lock button receiving bore, the assembly position corresponding to one of the forward position, the rearward position and a position therebetween; wherein with the male locking pin member withdrawn from the female socket and the lock button member in the assembly position, the female socket and the lock button opening align permitting insertion of the slide stop member into the lock button receiving bore via the female socket and the lock button opening so as to secure the slide stop member in the lock button receiving bore, and wherein the male locking pin member and lock button member are complementarily configured to provide a pin locking mechanism activatible when the pin member is in the fully seated position and to releasably lock the male locking pin member in the female socket against removal when the lock button member is in the forward position and to permit the male locking pin member to move in the female socket between the withdrawn position and the fully seated position when the lock button member is in the rearward position.

Another aspect of the present invention provides a lock for a casket, the casket having an upper lid portion pivotally connected to a lower box portion, the upper lid portion pivoting between an open position and a closed position, the lower box portion having a first bore having a first axis and a second bore with a second axis, the first and section axis intersecting and extending transversely from each other, the lock consisting of: a locking pin fixed to the upper lid portion which can be removably inserted into the second bore coaxially with the second axis when the upper lid portion is in the closed position; a push button slidably mounted in the first bore for movement along the first axis between a locking position and an unlocking position, the push button having a first surface and a second surface diametrically opposed to the first surface, the first surface having a lock slot and the second surface having a slide slot, the lock slot releasably engaging the locking pin when the upper lid portion is in the closed position; a spring for resiliently biasing the push button towards the locking position; a securing member for securing the push button within the first bore and inserted into the slide slot to prevent rotational movement of the push button about the first axis while allowing the push button to slidably move along the axis between the locking position and the unlocking position, wherein when the upper lid portion is in the open position, the lock slot aligns with the second bore so that the securing member can be inserted through the second bore, the lock slot and into the slide slot securing the push button within the first bore and when the upper lid portion is in the closed position, the lock slot engages the locking pin to prevent the upper lid portion from pivoting to the open position.

The inventor has appreciated that a locking mechanism in accordance with the present invention eliminates the need for a drive socket head to turn camber style devices thus making the present invention quick and easy to install and/or remove.

BRIEF DESCRIPTION OF THE DRAWINGS

The above-mentioned features as well as other features and objects of this invention and the matter of obtaining them will become more apparent and the invention itself will be best understood by reference to the following description of an embodiment of the invention taken in conjunction with the accompanying drawings in which:

FIG. 4 is a schematic perspective view showing the horizontal lock button of FIGS. 1 and 2 received in the horizontal slide bore.

FIG. 5 is a cross-sectional view of the lower box portion and the locking mechanism of FIG. 4 along the line 4–4' with the lock button in the rearward depressed position.

FIG. 6 is a cross-sectional view of the lower box portion and the locking mechanism similar to FIG. 5 but with the lock button in the forward extended position.

FIG. 7 is a cross-sectional view similar to FIG. 5 with the lock button in the rearward depressed position showing the upper lid in an open position.

FIG. 8 is a cross-sectional view similar to FIG. 5 with the lock button in the forward extended position and the upper lid closed.

DESCRIPTION OF THE PREFERRED EMBODIMENT

Figure 1:
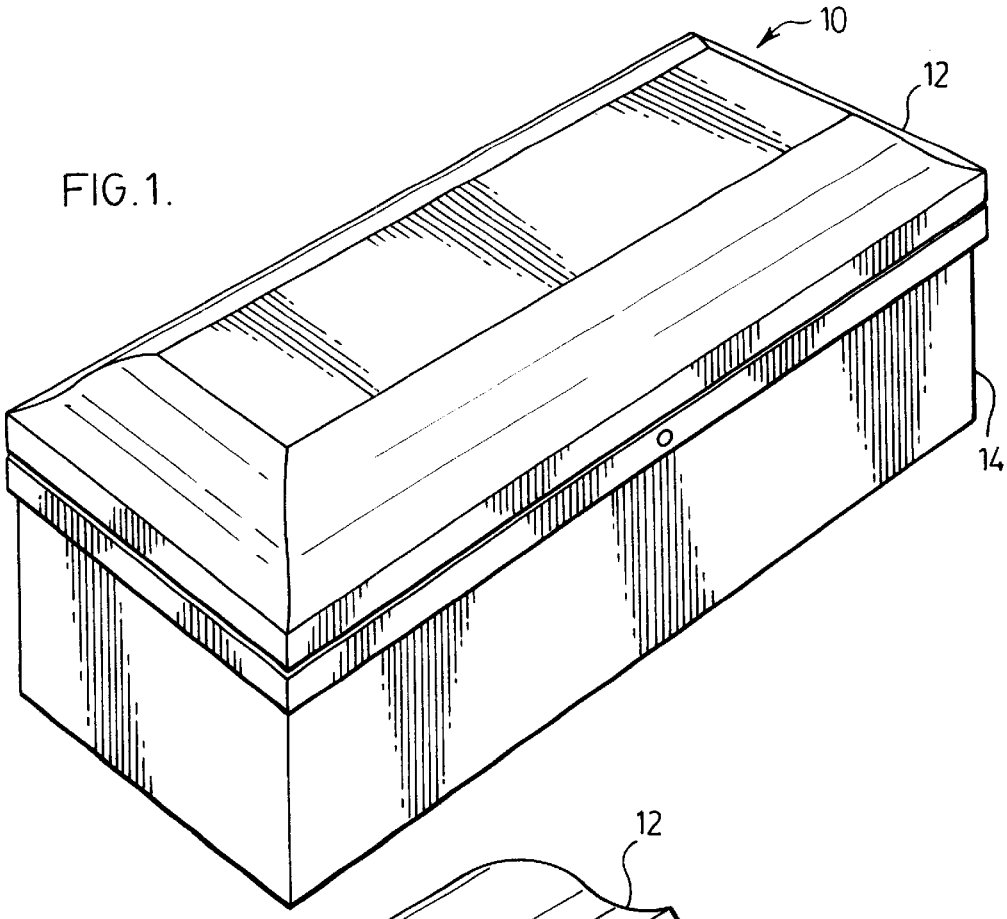
FIG. 1 is a perspective view of a funeral casket in the closed positions with a lock mechanism in accordance with the present invention.

Reference is made to FIGS. 1 to 4 which show, in overview, a funeral casket or coffin having an upper lid 12 provided with a vertically downward extending locking pin member 22. The lower lid has a vertical pin receiving socket 32 formed therein and adapted to receive the locking pin member 22 therein. The vertical pin receiving socket 32 opens into a horizontal slide bore 34. A lock button 42 is slidably received in the bore 34 biased outwardly by spring 88. The lock button 42 is limited in its sliding outwardly and limited in relative rotation in the slide bore 34 by a slide stop 68 passing through a slide slot 52 in the lock button 42. The lock button 42 serves to engage an enlarged head 28 of the locking pin member 22 and lock the upper lid 12 against opening when the enlarged head 28 is received inside the lock button 42. The spring 88 urges the lock button 42 to engage the enlarged head 28 and hold the enlarged head 28 against removal. Manually pushing the lock button 42 can glide the lock button 42 to a position in which an enlarged opening 54 of the lock button 42 permits the enlarged head of the locking pin member 22 to be removed.

Figure 2:
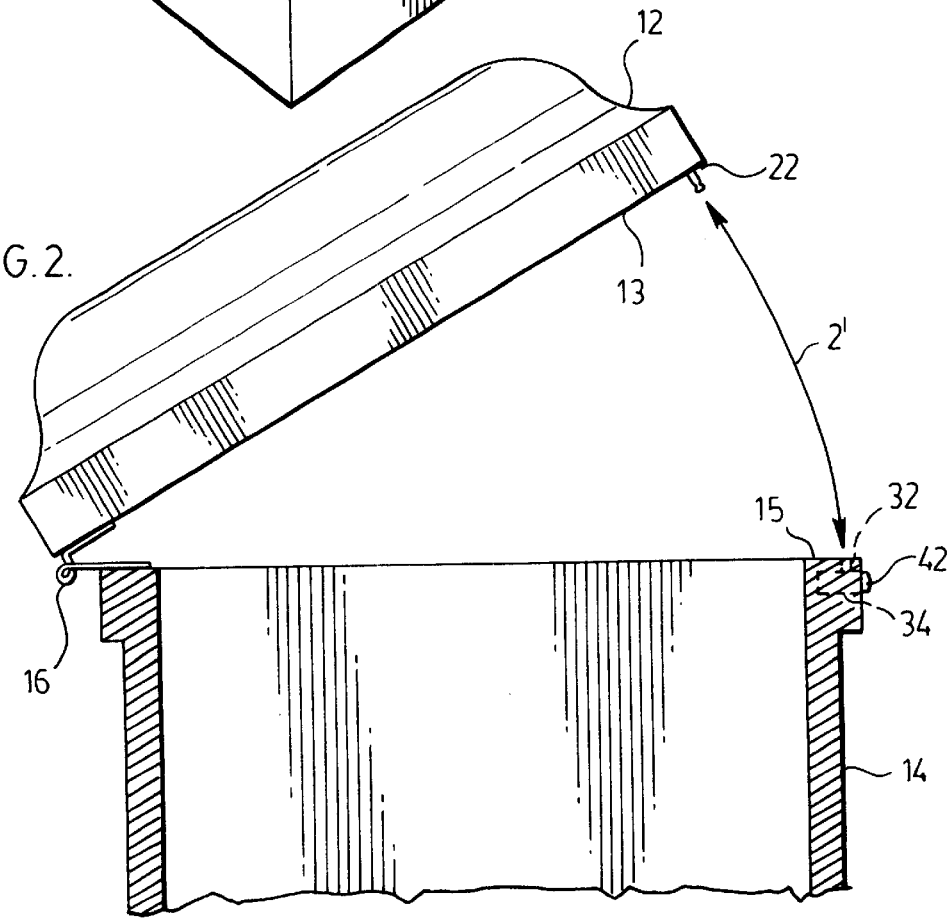
FIG. 2 is a cross-sectional view of the funeral casket of FIG. 1 cross-sectioned to bisect the lock mechanism.

Referring to FIGS. 1 and 2 in greater detail, a funeral casket 10 is provided with an upper lid 12 pivotally attached to a lower box section 14 by way of hinges 16. Casket 10 is preferably made of wood, wood composite or particleboard as is well known in the art. Upper lid 12 pivots relative to the lower box section 14 along a longitudinal axis passing through hinges 16. By way of hinges 16, the upper lid 12 pivots between an opened position as shown in FIG. 2, and a closed position as shown in FIG. 1, along two-headed arrow 2' as shown in FIG. 2.

Figure 3:
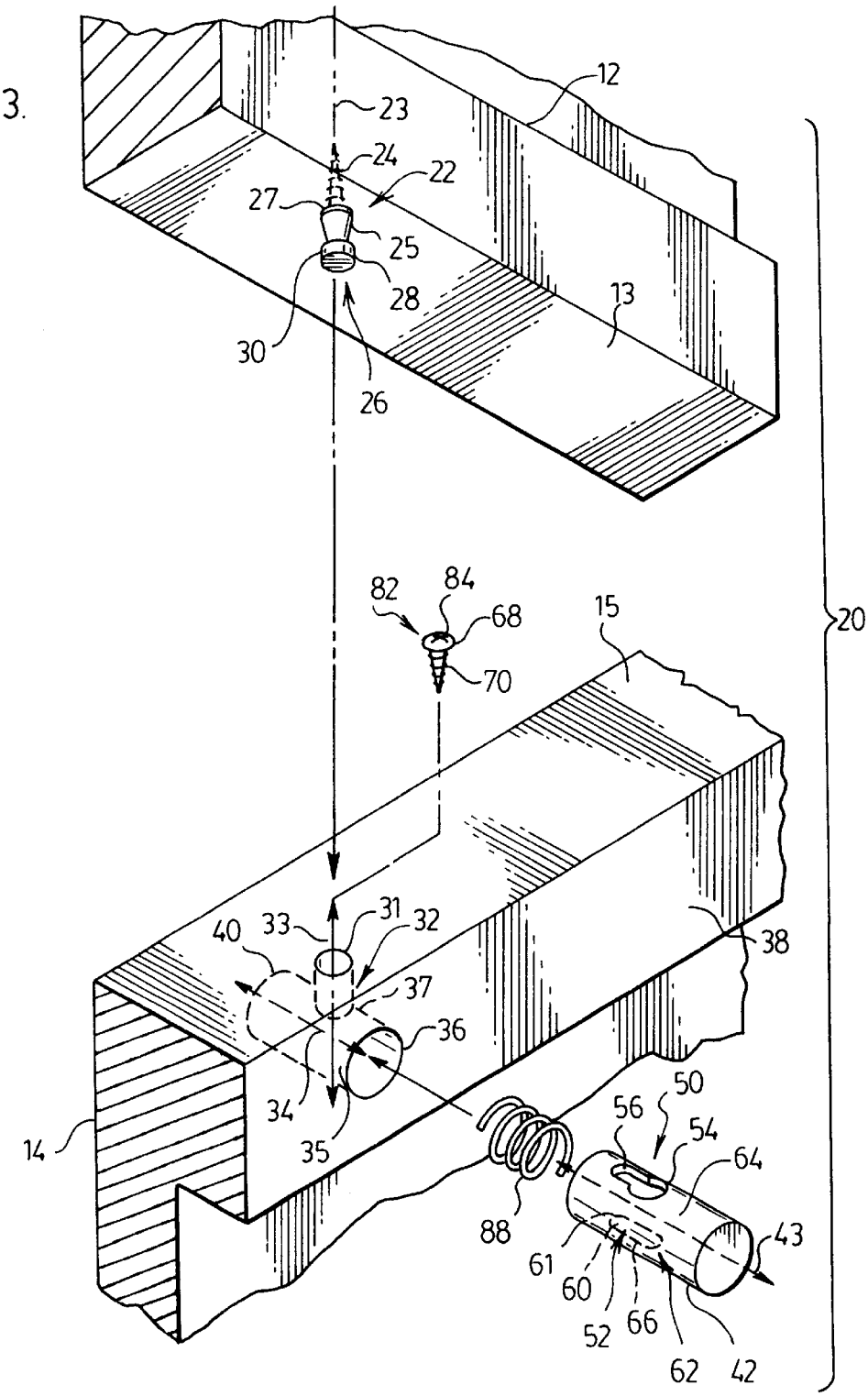
FIG. 3 is an enlarged exploded, partially sectioned perspective view of the lock mechanism of FIG. 2.

When the upper lid 12 is in the closed position, as shown in FIGS. 1 and 8, a lower face 13 of the upper lid 12, opposite the hinges 16, rests on an upper face 15 of the lower box section 14. This shall be referred throughout the disclosure as the "closed position". The upper lid 12 can pivot between the closed position and a position in which lower face 13 and upper face 15 are not in contact. Depending on the degree of upper lid 12 pivoting, the locking pin member will gradually be removed from or inserted into the pin receiving socket 32. When the locking pin member 22 is not engaged by the lock button 42, the upper lid 12 is in the open position, as shown in FIGS. 2, 3 and 7. This shall be referred to throughout the disclosure as the "open position".

As shown in greater detail in FIG. 3, a lock mechanism 20 is provided for releasably securing the upper lid 12 to the lower box section 14. The upper lid 12 has a locking pin member 22 extending vertically downward from the lower surface 13. The pin member 22 is elongate and extends from the lower surface 13, along a vertical socket axis 33. The locking pin member 22 has a threaded shank portion 24 for fixedly inserting into the wood of lower face 13. Locking pin member 22 also has a non-threaded shank portion 25. The threaded shank portion 24 is inserted into the wood of lower surface 13 until a shoulder 27 between the threaded shank portion 24 and the non-threaded shank portion 25 engages the lower surface 13.

At its outer distal end 26, the locking pin member 22 is provided with an enlarged head portion 28 which is of enlarged diameter relative to an adjacent portion of the non-threaded shank portion 25 so that the enlarged head portion 28 has an upwardly directed shoulder 30 facing towards lower face 13. Aside from the locking pin member 22 affixed into lower surface 13, the upper lid 12 is not otherwise modified to accommodate the locking mechanism.

FIG. 3 also provides a perspective representation of the lower box section 14. The lower box section 14 has formed therein a vertical cylindrical pin receiving socket 32 which extends vertically downward from an opening 31 in the upper surface 15. Pin receiving socket 32 generally extends from opening 31 along a vertical socket axis 33 downward to intersect and open into a horizontally extending cylindrical slide bore 34 at opening 37. The slide bore 34 generally extends horizontally, along a horizontal lock axis 35, into lower box section 14 from an opening 36 at front surface 38 of the lower box section 14 to a blind end 40. As seen from FIG. 3, vertical socket axis 33 and horizontal lock axis 35 intersect and extend transversely relative to each other. Pin receiving socket 32 and slide bore 34 can be easily drilled into upper surface 15 and front surface 38 of lower box section 14 using standard drilling equipment.

Pin receiving socket 32 has an opening 31 in upper surface 15, sized to be able to receive the locking pin member 22. As seen in FIG. 2, when upper lid 12 pivots along the directions indicated by two headed arrow 2', between the opened and closed positions, locking pin member 22 is inserted into and/or withdrawn from the pin receiving socket 32. When the upper lid 12 is in the opened position, as shown in FIGS. 2, 3 and 7, locking pin member 22 is withdrawn from the pin receiving socket 32. When locking pin member 22 has been withdrawn from the pin receiving socket 32, this shall be referred to as the "withdrawn position" throughout the disclosure. As shown in FIGS. 1 and 8, when the upper lid 12 is in the closed position, locking pin member 22 is inserted through the opening 31, into the pin receiving socket 32 so that a portion of the non-threaded portion 25 and the enlarged head 28 extend into the slide bore 34. When the locking pin member 22 is in this position, this shall be referred to as the "fully seated position" throughout the disclosure. It will be understood that whenever the upper lid 12 is in the closed position, the locking pin member will be in the fully seated position, as shown in FIG. 1 and 8.

As shown in FIG. 8, when in the fully seated position, the enlarged head portion 28 and a portion of the non-threaded shank portion 25 extend through opening 37 and into the slide bore 34. When the upper lid 12 is in the closed position and the locking pin member 22 is in the fully seated position, the locking pin member 22 can be releasably engaged by the lock button 42 such that locking pin member 22 cannot be removed from pin receiving socket 32. In this configuration, upper lid 12 is secured to the lower box section 14.

FIGS. 5 to 8 show vertical cross sections of the upper lid 12, lower box section 14 and locking mechanism 20 in accordance with the present invention. Slide bore 34 is sized so as to receive lock button 42 through the opening 36. Lock button 42 is disposed about a button axis 43 which is coaxial with the lock axis 35 of slide bore 34. Lock button 42 is coaxially slidably received in slide bore 34 for horizontal movement along the lock axis 35 between an extended forward position, as shown in FIGS. 6 and 8, and a depressed rearward position, as shown in FIGS. 4, 5 and 7.

FIGS. 3 to 8 provide perspective and cross-sectional views of the lock button 42. As best shown in FIG. 4, lock button 42 is cylindrical about the button axis 43. Lock button 42 may be made of metal, wood, plastic or the like, while metal is preferred. The lock button 42 is formed as a bullet-like cylindrical member with a partially rounded closed forward end 44 and a central rearwardly opening coaxial blind bore 58 extending forwardly from an open rearward end 46 so as to provide continuous annular tube wall 40 about the central opening or bore 58. A lock slot 50, longitudinally extending along the button axis 43, is formed in an upper section 49 of tube wall 48. A slide slot 52, also extending longitudinally along the button axis 43, is formed in a lower section 51 in the tube wall 48 diametrically opposed to the lock slot 50.

As shown in FIG. 3, slide bore 34 is cylindrical about lock axis 35. As such, lock button 42 and slide bore 34 are shaped and sized so that lock button 42 fits within slide bore 34 and is slidable along the horizontal lock axis 35 with the button axis 42 substantially co-axial to the lock axis 35. Lock button 42 can slide horizontally along lock axis 35 between the extended forward and the depressed rearward positions.

As shown in FIGS. 3 and 4, lock button 42 is provided with lock slot 50 and slide slot 52. Both lock slot 50 and slide slot 52 extend longitudinally along button axis 43. Lock slot 50 comprises a passage portion 54 and a catch portion 56. Passage portion 54 is circular and has a diameter sufficient to allow enlarged head portion 28 and non-threaded shank portion 25 of the locking pin member 22 to pass through. The catch portion 56 is elongate and extends along the tube wall 48 from the passage portion 55, parallel to the button axis 43. Catch portion 56 has a circumferential width 57 narrower than the diameter 55 of the circular passage portion 56. The width 57 is sized so that the enlarged head portion 28 cannot pass through but the reduced size portions of the non-threaded shank portion 25 adjacent the enlarged head portion 28 can pass through. If the threaded shank portion 25 is attempted to be withdrawn upwardly from the catch portion 56, the upwardly directed shoulder 30 of the locking pin member will engage the lower directed surface 53 of upper section 49 of the lock button 42. With the lock slot 50 having the above-noted configuration, the locking pin member 22 can be releasably locked in the fully seated position.

As shown in FIG. 6, when the lock button 42 is in the forwardly extended position, the locking pin member 22 is received in the catch portion 56 and the enlarged head portion 28 of the locking pin member 22 can not pass through the catch portion 56 due to its narrow width 57. To allow the upper lid 12 to pivot into the closed position, passage portion 54 must be aligned with opening 37 to allow the enlarged head portion 28 to pass through passage portion 54. This is accomplished by a user sliding the lock button 42 horizontally along the lock axis 35 from the forward extended position to the rearward depressed position by application of a force, as best shown in FIG. 7. Once so aligned, as shown in FIG. 7, upper lid 12 can be moved between the opened position and the closed position. When the locking pin member 22 in the fully seated position, as shown in FIG. 8, the enlarged head portion 28 extends through opening 37 into the slide bore 34.

In order to releasably secure the upper lid 12 to the lower box section 14, spring 88 urges the lock button 42 to slide horizontally within slide bore 34 along the lock axis 35 from the rearward depressed position to the forwarded extended position. In the lock button 42 sliding from the rearward depressed position to the forward extended position with the locking pin member 22 in the fully seated position, the lock slot 50 slides from a position with the passage portion 54 about the locking pin member 22 to a position with the catch portion 56 about the locking pin member 22. Subsequently, the upper lid 12 pivots towards the open position, upwardly directed shoulder 30 of the enlarged head 28 of the locking pin member 22 engages the downwardly directed surface 53 of the upper section 49 of the tube wall 48. Downwardly directed surface 53 of the upper portion 49 engages the shoulder 30 because enlarged head portion 28 cannot pass through the catch portion 56. Consequently, locking pin member 22 is held in the fully seated position. As the locking pin member cannot be withdrawn from the pin receiving socket 32, locking pin member 22 is maintained in the fully seated position.

To release the locking pin member 22, a user urges lock button 42 into the depressed rearward position, locating the passage portion 54 about the locking pin member 22 so as to allow the enlarged head 28 to move through the passage portion 54 and permit the upper lid 12 to pivot from the closed position to the opened position.

As shown in FIGS. 3 and 4, slide slot 52 is provided diametrically opposite to the lock slot 50. Slide slot 52 extends horizontally parallel to the button axis 43. Slide slot 52 has a closed rear end 60, a closed forward end 62, and two opposite sides 64 and 66.

As shown in FIGS. 3 to 8, a screw-like slide stop 68 is provided in lock mechanism 20. Slide stop 68 has similarities in configuration to locking pin member 22. Slide stop 68 is elongate. Slide stop 68 has a threaded shank portion 70 for fixedly inserting slide slot into the wood of lower surface 74 of slide bore 34. Slide stop 68 is also provided with a non-threaded shank portion 72 and an enlarged head portion 84 of the outer distal end 82. A stop shoulder between the threaded shank portion 70 and the non-threaded shank portion 72 determines the extent to which the slide stop 68 is threaded into the lower surface of the slide bore. The enlarged head portion 84 has a diameter greater than the non-threaded shank portion 72 and has a downwardly directed shoulder 86. Slide slot 52 is of sufficient width to permit passage of threaded shank portion 70 and non-threaded shank portion 73 through the slide slot. The width of slide slot 52, however, is sufficiently narrow to prevent passage of the enlarged head portion 84 of the slide stop 68. The non-threaded shank portion 72 is slightly narrower in diameter than the width of slide slot 52 between the opposing sides 64 and 65 so as to permit the lock button to freely slide axially yet to retain the lock button against relative rotation about the lock axis 35. The axial length of non-threaded shank portion 72 is greater than the height of lower section 51 above the lower surface of the slide bore 34 so as to permit the lock button 42 to freely slide along the lock axis 35. The lock button is maintained in the slide bore by the closed rear end 60 of the slide slot 50 engaging the non-threaded shank portion 72.

A biasing spring 88 is inserted into slide bore 34 between the blind end 40 of the side bore and the lock button. The biasing spring 88 may consist of any type of spring that is capable of urging the lock button 42 towards the extended forward position.

To install lock button 42 in slide bore 34, spring 88 is first inserted into slide bore 34. Lock button 42 is then inserted into slide bore 34. A user pushes lock button 42 into the depressed rearward position, against the force of the spring 88. In doing so, passage portion 54 as well as a portion of the slide slot 52 are coaxially aligned with the pin receiving socket 32 along the socket axis 33, as best shown in FIG. 4. In such a configuration, a passage is formed by alignment of the pin receiving socket 32, passage portion 54, lock button opening 58 and a portion of the slide slot 52. As best shown in FIG. 4, slide stop 68 may be aligned above socket 32 and inserted, as with a screw driver (not shown) through the pin receiving socket 32, passage portion 54, and a portion of the slide slot 52 to allow threaded shank portion 70 to be inserted into the lower surface 74 of the slide bore 34. FIG. 5 shows the slide stop 68 after its has been inserted. When the user releases the lock button 42, the force of the spring 88 biases the lock button 42 into the extended forward position until the closed rear end 60 of the lock slot 52 engages the non-threaded shank portion 72 of the slide stop 68, arresting the forward movement of the lock button 42. As a result, the lock button 42 is maintained in the slide bore 34 by slide stop 68.

When slide stop 68 engages closed rear end 60 of the slide slot 52, removal of lock button 42 out of opening 36 of slide bore 34 is prevented. The non-threaded portion 72 of the slide stop 68 also engages with opposing sides 64 and 66 of slide slot 52 preventing the relative rotation of lock button 42 about the lock axis 43 within slide bore 34.

The lock button 42 is biased towards the forward extended position by spring 88. In order to close the upper lid 12, the passage portion 54 of the lock slot 50 and the pin receiving socket 32 must be aligned to allow passage of the enlarged head 28 of the locking pin member 22, as by a user pushing the lock button 42 towards the depressed rearward position, as represented in FIG. 7 by the large arrow, against the biasing force of spring 88 until passage portion 54 and pin receiving socket 32 become vertically aligned. Once vertically aligned, as shown in FIG. 7, upper lid 12 can pivot into the closed position relative to the lower box section 14 since the enlarged head 28 of the locking pin member 22 can then pass through the passage portion 54 into the lock button opening 58 to allow the locking pin member 22 to move into the fully seated position.

Once the user releases the lock button 42, the action of the spring 88 forces lock button 42 to slide horizontally from the depressed rearward position along the lock axis 35 into the forward extended position, as shown in FIG. 8. In the forward extended position, the upwardly directed shoulder 30 of the locking pin member 22 can be engaged by the downwardly directed surface 53 of the upper section 49 so as to prevent the locking pin member 22 from moving out of the pin receiving socket 32.

To release the upper lid 12, the push button 42 is pushed by a user into the depressed rearward position, allowing the enlarged head portion 28 to traverse the passage portion 54 allowing the upper lid 12 to pivot to the open position.

It will be understood by a person skilled in the art that the many modifications can be made to the preferred embodiment noted above without detracting from the functioning of the invention. More specifically the locking mechanism can also be used in apparatus other than caskets when a first and a second member must be releasabley fastened to each other. Examples where the locking mechanism could be used include shipping crates and fence gates.

It is to be appreciated that rather than use the preferred locking pin member and slide stop illustrated, simpler members such as conventional screws could be used.

It will also be understood that the lock button 42 need not have a circular cross section as shown in FIG. 4. Lock button 42 may have many other cross-sectional profiles including a square cross section (not shown). If lock button 42 has a square cross section, slide bore 34 preferably will be similarly square shaped and sized to slidingly receive the lock button 42. Lock button 42 can also be keyed for example so as to provide a radial key on boss to be received in a complementary key way in the slide bore so as to prevent the lock button from rotating about the lock axis in the slide bore. The rearward end 46 of the lock button need not be open. Rearward end 46 may also be closed as may be useful to be more securedly engaged by spring 88.

It will be appreciated that the lock slot 50 and the lock pin member 22 can be configured to automatically cam the lock button 42 from the forward extended position to the rearward depressed position. In this configuration, a user need not slide the lock button 42 horizontally along the lock axis 35 to allow the upper lid 12 to close. In this embodiment, lock slot 50 may be configured to provide a slopping cam surface to guide the enlarged head 28 into passage portion 54. Enlarged head 28 of locking pin member 22 can have a rounded end so that when upper lid 12 is moved into the closed position, enlarged head 28 acting on the slopping cam surface of lock slot 50 cams the lock button 42 to slide horizontally from the forward extended position into the rearward depressed position automatically. When the rounded end of enlarged head 28 passes through the passage portion 54 of lock slot 50, spring 88 will then urge the lock button 42 to slide horizontally into the forward extended position. Such a configuration will allow the upper lid 12 to be closed and the locking mechanism 20 secure the upper lid 12 to the lower box portion, without the user having to push lock button 42 into the rearward depressed position.

In yet another embodiment, the size of head 84 of slide stop 68 may be sufficiently narrow to permit slide stop 68 to pass through either passage portion 54 or the catch portion 56 of the lock slot 50. With head 84 of slide stop 68 so sized, this can make it easier for a user to install the lock button 42 in the slide bore 34 since it would not be necessary to align the passage portion of lock slot 50 with the pin receiving socket 32.

Slide slot 52 and lock slot 50 need not extend horizontally parallel with button axis 43. More specifically, both slide slot 52 and the catch portion 56 lock slot 50 may extend coaxially and at least part circumferentially so as to curve along lower section 51 and upper section 49 respectively (not shown). Catch portion 56 of the lock slot 50 and slide slot 52 may curve in a complementary manner so that the locking pin member 22 rotates along the button axis 43 as it moves between the rearward depressed position and the forward extended position.

The foregoing is considered as illustrative only of the principles of the invention. As numerous modifications and changes will readily occur to those skilled in the art, it is not desired to limit the invention to the exact construction and operation shown and described, and accordingly, all suitable modifications and equivalents may be resorted to, falling within the scope of the invention as claimed.

I claim:

1. A lock mechanism releasably securing a first member to a second member;

the first member having a male pin member extending therefrom, the pin member having a distal end;

the second member having a female socket extending about a socket axis and having an open socket end;

the male pin member axially slidable into and out of the female socket via the open socket end between a withdrawn position in which the pin member is withdrawn from the socket and a fully seated position in which the pin member is coaxially received in the socket for locking in the socket against removal;

the second member having a lock button receiving bore disposed about a lock axis, the lock button receiving bore having an open forward end and a closed rear end, the lock button receiving bore intersecting with the female socket with the lock axis intersecting the socket axis to extend transversely thereto;

a lock button member, the lock button member coaxially slidably received in the lock button receiving bore for movement between a forward position and a rearward position;

a slide stop member in the lock button receiving bore engaging an axially forwardly directed shoulder of the lock button member to limit forward movement of the lock button member in the lock button receiving bore to the forward position and prevent removal of the lock button member out of the forward end of the lock button receiving bore and to prevent relative rotation of the lock button member about the lock axis;

a lock button opening extending radially through the lock button member providing access to the slide stop member and permitting insertion of the slide stop member through the lock button member for securing the lock button member in the lock button receiving bore during assembly, the lock button opening being coaxially aligned with the female socket when the lock button member is in an assembly position in the lock button receiving bore, the assembly position corresponding to one of the forward position, the rearward position and a position therebetween;

wherein with the male pin member withdrawn from the female socket and the lock button member in the assembly position, the female socket and the lock button opening align permitting insertion of the slide stop member into the lock button receiving bore via the female socket and the lock button opening so as to secure the slide stop member in the lock button receiving bore, and wherein the male pin member and lock button member are complementarily configured to provide a pin locking mechanism activatible when the pin member is in the fully seated position to releasably lock the male pin member in the female socket against removal when the lock button member is in the forward position and to permit the male pin member to move in the female socket between the withdrawn position and the fully seated position when the lock button member is in the rearward position.

2. A lock mechanism as claimed in claim 1 wherein the male pin member further comprises an enlarged portion and a reduced portion, the enlarged portion located closer to the distal end of the male pin member than the reduced portion; and the lock button opening further comprising a lock slot having a passage portion and a catch portion wherein when the lock button member is in the rearward position, the passage portion is coaxially aligned with the female socket and permits passage of the enlarged portion of the male pin member into and out of the lock button member coaxially to the socket axis, and when the lock button member is in the forward position the catch portion is coaxially aligned with the female socket, and wherein the catch portion is sized to permit the reduced portion of the male pin member to extend therethrough coaxially to the female socket but to prevent the enlarged portion to pass therethrough thus retaining the pin member once in the locked position, in the locked position.

3. A lock mechanism as claimed in claim 2 wherein the lock slot opens radially into the lock button opening.

4. A lock mechanism as claimed in claim 3 wherein the lock button member further comprises a slide stop slot diametrically opposite to the lock slot, the slide stop slot extending coaxially with a button axis of the lock button member and having a rear end and a forward end, and two opposite sides spaced by a width, the rear end forming the axially forwardly directed shoulder, the slide stop member further comprising a post having a distal end which projects into the lock button receiving bore from a side of the lock button receiving bore opposite the side of the lock button receiving bore opening into the female socket, the post having a shank of reduced size compared to the size of the distal end of the post, wherein the width of the slide stop slot permits passage of the shank of the post therethrough to secure the post to the second member during assembly, yet preventing passage of the distal end therethrough.

5. A lock mechanism as claimed in claim 4 wherein the lock button member is accessible for manual engagement by a user via the open forward end of the lock button receiving bore.

6. A lock mechanism as claimed in claim 5 wherein the lock button member further comprises a forward end which extends beyond the open forward end of the lock button receiving bore for manual engagement by user.

7. A lock mechanism as claimed in claim 6 wherein the lock button member further comprises a hollow tubular member about the button axis, the tube having a tube wall, wherein the lock slot is formed in the tube wall on one side of the tube and the slide stop slot is formed in the tube wall on a side diametrically opposite to the one side having the lock slot formed therein.

8. A lock mechanism as claimed in claim 7 wherein the passage portion comprises a generally circular portion, the catch portion comprising an elongated portion extending along the tube wall from the passage portion coaxial with the button axis and elongated portion is of a width less than a diameter of the circular portion.

9. A lock mechanism as claimed in claim 8 wherein when the passage portion is coaxially aligned with the female socket, the slide stop slot has a portion thereof also coaxially aligned with the female socket permitting insertion of the shank of the post therethrough for assembly and disassembly.

10. A lock mechanism as claimed in claim 9 wherein the distal end of the post is approximately the same size as the enlarged portion of the male pin member.

11. A lock mechanism as claimed in claim 10 wherein the lock button receiving bore is cylindrical, and the lock button member further comprises a cylindrical exterior sized to be smaller than a diameter of the lock button receiving bore for coaxial sliding along the button axis of the lock button member in the lock button receiving bore.

12. A lock mechanism as claimed in claim 11 wherein the female socket is generally cylindrical and the lock button receiving bore further comprises a generally circular cross-section.

13. A lock mechanism as claimed in claim 12 wherein the post further comprises a generally circular cross-section and the male pin member further comprises a generally circular cross-section.

14. A lock for a casket, the casket having an upper lid portion pivotally connected to a lower box portion, the upper lid portion pivoting between an open position and a closed position, the lower box portion having a first bore having a first axis and a second bore with a second axis, the first and section axis intersecting and extending transversely from each other, the lock consisting of:

a locking pin fixed to the upper lid portion which can be removably inserted into the second bore coaxially with the second axis when the upper lid portion is in the closed position;

a push button slidably mounted in the first bore for movement along the first axis between a locking position and an unlocking position, the push button having a first surface and a second surface diametrically opposed to the first surface, the first surface having a lock slot and the second surface having a slide slot, the lock slot releasably engaging the locking pin when the upper lid portion is in the closed position;

a spring for resiliently biasing the push button towards the locking position;

a securing member for securing the push button within the first bore and inserted into the slide slot to prevent rotational movement of the push button about the first axis while allowing the push button to slidably move along the axis between the locking position and the unlocking position;

wherein when the upper lid portion is in the open position, the lock slot aligns with the second bore so that the securing member can be inserted through the second bore, the lock slot and into the slide slot securing the push button within the first bore and when the upper lid portion is in the closed position, the lock slot engages the locking pin to prevent the upper lid portion from pivoting to the open position.

15. The lock of claim 14 wherein the lock slot further comprises a passage portion and a catch portion wherein when the push button is in the unlocked position, the passage portion is coaxially aligned with second bore to permit passage of the locking pin into and out of the second bore when the upper lid portion pivots between the closed and the open position, respectively, and when the push button is in the locked portion, the catch portion engages the lock pin to prevent the upper lid portion from pivoting to the open position.

16. The lock of claim 15 wherein the first bore has a generally cylindrical diameter and cross-section and the push button has a generally cylindrical exterior sized to be smaller than the diameter of the first bore for slidable movement along the axis in the first bore.

17. The lock of claim 16 wherein the push button further comprises a hollow tube, the tube having a tube wall, the tube wall forming the first and second side.

18. The lock of claim 17 wherein the passage portion comprises a generally cylindrical portion and the catch portion comprises an elongated portion extending along the first side from the passage portion coaxially with the first axis and of a width less than a diameter of the circular portion.

19. The lock of claim 18 wherein the securing member is a screw.

* * * * *